US011285719B2

(12) United States Patent
Imoto

(10) Patent No.: US 11,285,719 B2
(45) Date of Patent: Mar. 29, 2022

(54) LIQUID DISCHARGE APPARATUS

(71) Applicant: Ricoh Company, Ltd., Tokyo (JP)

(72) Inventor: Shinji Imoto, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/571,657

(22) Filed: Sep. 16, 2019

(65) Prior Publication Data

US 2020/0086643 A1 Mar. 19, 2020

(30) Foreign Application Priority Data

Sep. 19, 2018 (JP) ..... JP2018-174759

(51) Int. Cl.
*B41J 2/14* (2006.01)
*B41J 2/165* (2006.01)

(52) U.S. Cl.
CPC ..... *B41J 2/14088* (2013.01); *B41J 2/16526* (2013.01); *B41J 2/16579* (2013.01)

(58) Field of Classification Search
CPC .. B41J 2/2114; B41J 2/04501; B41J 2/14088; B41J 2/16517; B41J 2/16526
See application file for complete search history.

(56) References Cited

U.S. PATENT DOCUMENTS 5,355,158 A * 10/1994 Inada ..... B41J 2/16517 347/22
6,074,052 A * 6/2000 Inui ..... B41J 2/2114 347/101
6,402,292 B1 * 6/2002 Ninomiya ..... B41J 2/04505 347/35
2006/0055754 A1 3/2006 Sakuma et al.
2006/0256352 A1 11/2006 Kogure et al.
2006/0268085 A1 * 11/2006 Konno ..... B41J 2/2114 347/100
2007/0103532 A1 5/2007 Imoto et al.
2007/0109385 A1 5/2007 Imoto et al.
2008/0043083 A1 2/2008 Imoto et al.
2008/0106566 A1 5/2008 Kogure et al.
2008/0145123 A1 6/2008 Kogure et al.
2009/0052917 A1 2/2009 Kogure et al.
2009/0073211 A1 3/2009 Imoto
2009/0074461 A1 3/2009 Imoto
(Continued)

FOREIGN PATENT DOCUMENTS

JP 9-267481 10/1997
JP 2007-31 3654 12/2007
JP 2018-154030 10/2018

*Primary Examiner* — John Zimmermann
(74) *Attorney, Agent, or Firm* — Xsensus LLP

(57) ABSTRACT

A liquid discharge apparatus includes a liquid discharge head configured to discharge a liquid to a medium, a heater configured to heat the liquid in the liquid discharge head, and circuitry configured to cause the heater to heat the liquid in the liquid discharge head, cause the liquid discharge head to discharge the liquid heated by the heater to the medium as a discharge operation, cause the liquid discharge head to discharge the liquid heated by the heater to a portion other than the medium as a dummy discharge operation after the discharge operation, and cause the heater to stop heating the liquid in the liquid discharge head after the dummy discharge operation.

11 Claims, 10 Drawing Sheets

(56) References Cited

U.S. PATENT DOCUMENTS

| | | | | |
|---|---|---|---|---|
| 2009/0151625 | A1 | 6/2009 | Matsumoto et al. | |
| 2010/0245420 | A1 | 9/2010 | Ichimura et al. | |
| 2010/0245460 | A1 | 9/2010 | Imoto et al. | |
| 2011/0057988 | A1 | 3/2011 | Izumikawa et al. | |
| 2011/0115853 | A1* | 5/2011 | Long | B41J 2/2142 347/56 |
| 2011/0220017 | A1 | 9/2011 | Kitaoka et al. | |
| 2011/0310185 | A1 | 12/2011 | Komaba et al. | |
| 2012/0060754 | A1 | 3/2012 | Kitaoka et al. | |
| 2012/0160161 | A1 | 6/2012 | Sakura et al. | |
| 2012/0249627 | A1 | 10/2012 | Komaba et al. | |
| 2012/0249670 | A1* | 10/2012 | Sugahara | B41J 2/16526 347/26 |
| 2014/0267486 | A1 | 9/2014 | Imoto | |
| 2015/0070432 | A1 | 3/2015 | Imoto | |
| 2017/0253046 | A1* | 9/2017 | Moscato | B41J 2/16544 |

* cited by examiner

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-174759, filed on Sep. 19, 2018 in the Japan Patent Office, the entire disclosures of which is hereby incorporated by reference herein.

BACKGROUND

Technical Field

Aspects of this disclosure relate to a liquid discharge apparatus.

Related Art

A liquid discharge apparatus includes a liquid discharge head to discharge a liquid and a heater to heat the liquid in the liquid discharge head.

For example, an inkjet printer as an example of the liquid discharge apparatus heats ink (liquid) in a recording head (liquid discharge head) and discharges the ink in a low viscosity state to record an image. It is preferable to continue heating to maintain temperature of the liquid in the liquid discharge head even if the liquid discharge operation is finished and the inkjet printer is in a standby state.

SUMMARY

In an aspect of this disclosure, a liquid discharge apparatus includes a liquid discharge head configured to discharge a liquid to a medium, a heater configured to heat the liquid in the liquid discharge head, and circuitry configured to cause the heater to heat the liquid in the liquid discharge head, cause the liquid discharge head to discharge the liquid heated by the heater to the medium as a discharge operation, cause the liquid discharge head to discharge the liquid heated by the heater to a portion other than the medium as a dummy discharge operation after the discharge operation, and cause the heater to stop heating the liquid in the liquid discharge head after the dummy discharge operation.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
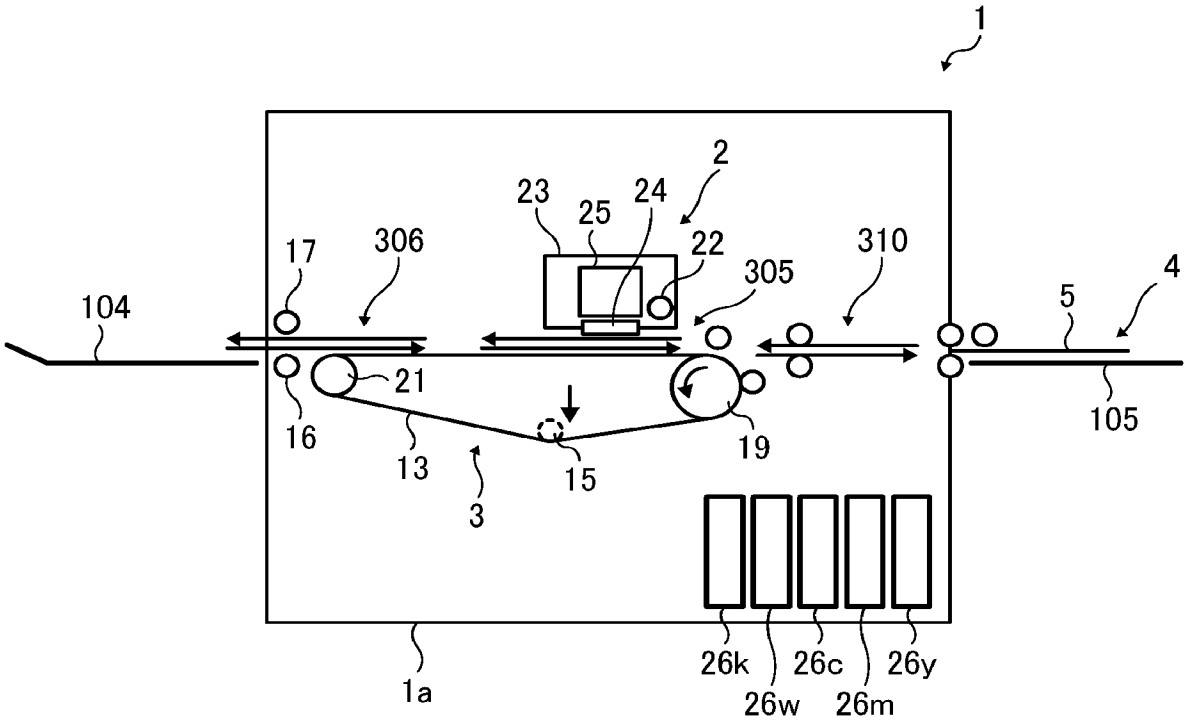
FIG. 1 is a schematic side view of an internal configuration of an inkjet printer according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. A liquid discharge head according to an embodiment of the present disclosure is described with reference to FIGS. 1 through 3.

An embodiment of an inkjet printer 1 as an example of a liquid discharge apparatus according to the present disclosure is described below with reference to FIGS. 1 to 3.

FIG. 1 is a side view of an example of an internal configuration of the inkjet printer 1 according to the present disclosure.

Figure 2:
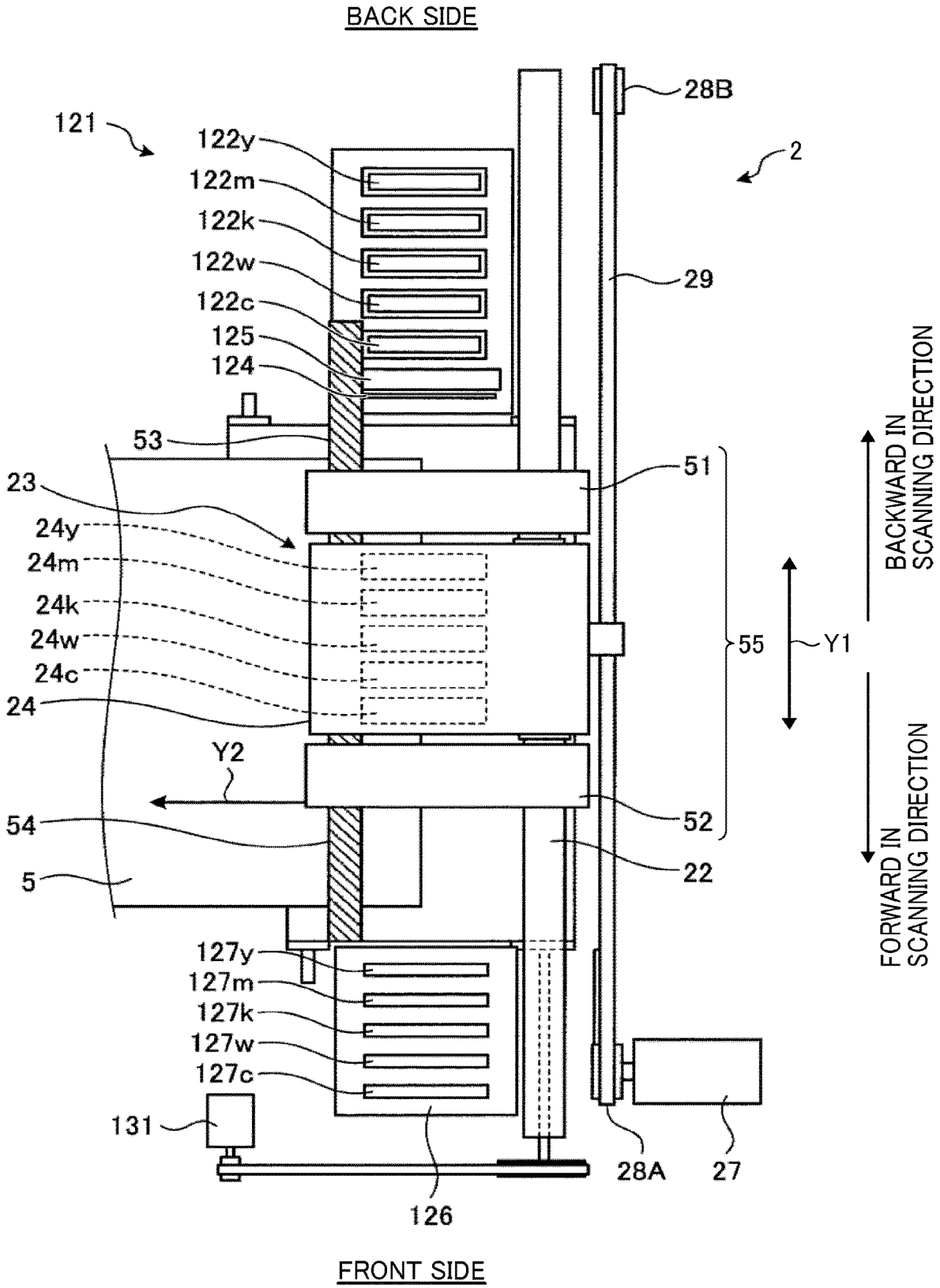
FIG. 2 is a plan view of an example of a configuration of an image forming unit of the inkjet printer.

FIG. 2 is a plan view of an example of a configuration of an image forming unit of the inkjet printer 1.

Figure 3:
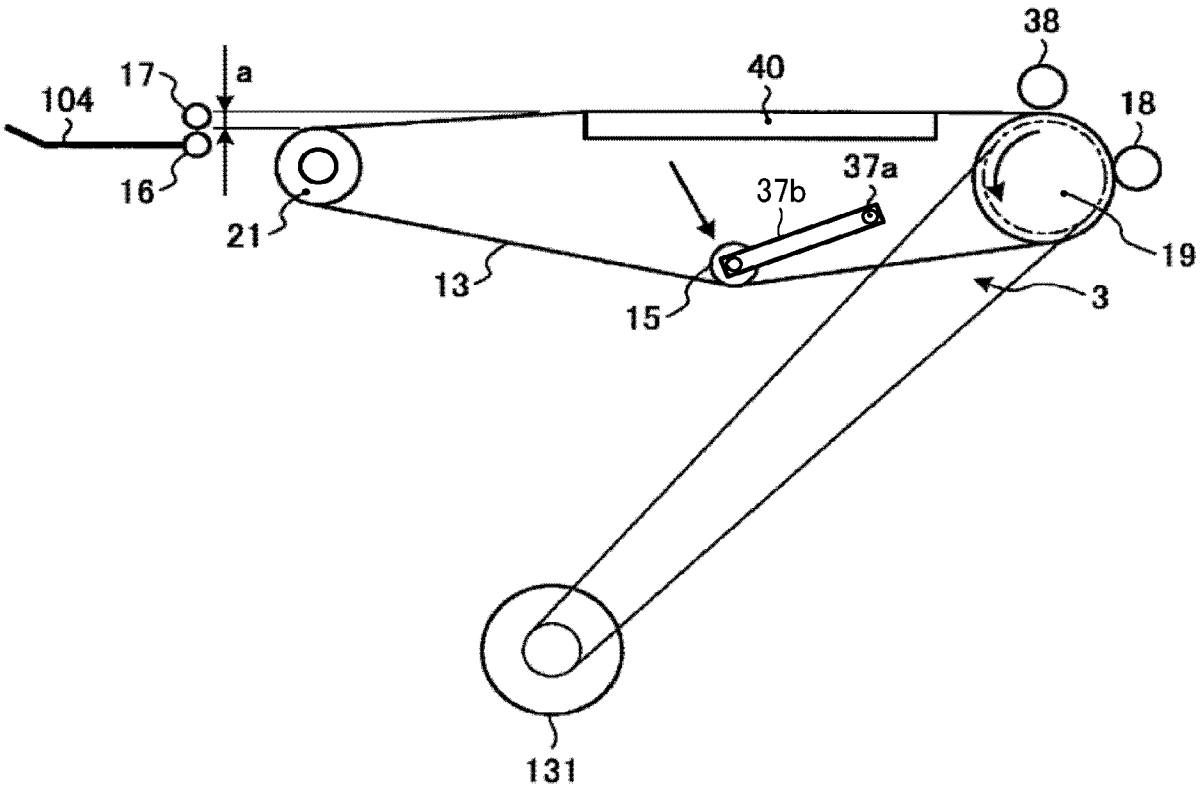
FIG. 3 is a side view of an example of a configuration of a conveyor of the inkjet printer.

FIG. 3 is side view of an example of a configuration of a conveyor of the inkjet printer 1.

FIG. 1 illustrates an image forming unit 2, a sub-scanning conveyor 3, and a sheet feeder 4.

A sheet 5 placed on a sheet feed tray 105 is conveyed along a conveyance paths 310, 305, and 306, and is discharged onto an ejection tray 104. A conveyance belt 13 conveys the sheet 5 as a recording material along the conveyance path 305, and the image forming unit 2 forms an image on the sheet 5. The image forming unit 2 includes a carriage 23 and the like. The carriage 23 includes a recording head 24 as a liquid discharge head, a sub tank 25, an irradiator 55, and the like. The irradiator 55 includes UV lamps 51 and 52 (see FIG. 2).

Hereinafter, the "recording head" is simply referred to as the "head".

Figure 6A:
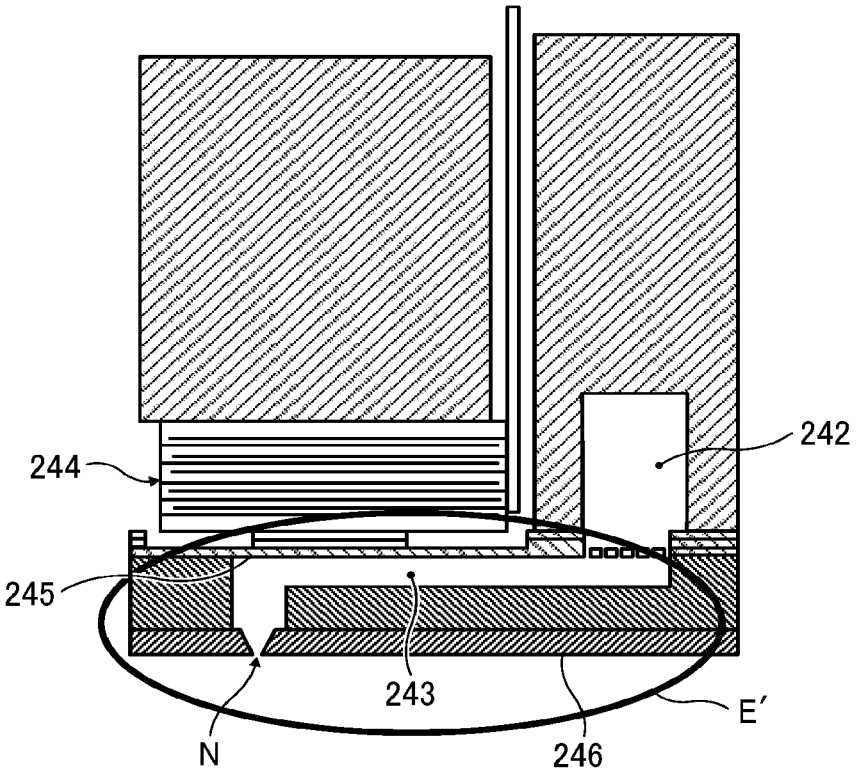
FIGS. 6A and 6B are cross-sectional side views of the liquid discharge head along a cross-section passing through the nozzle N.

The head 24 includes a plurality of heads 24*y* to 24*c* (see FIG. 2) arranged in a main scanning direction indicated by arrow "Y1" (see FIG. 2). Each of the plurality of heads 24*k*, 24*w*, 24*c*, 24*m*, and 24*y* has a liquid discharge area in which many nozzles N (discharge holes) are arranged (see FIGS. 6A and 6B). The liquid is discharged from the nozzles of the heads 24*y* to 24*c*. The head 24*k* discharges black (Bk) ink. The head 24*w* discharges white (W) ink. The head 24*c* discharges cyan (C) ink. The head 24*m* discharges magenta (M) ink. The head 24*y* discharges yellow (Y) ink. The inks of the respective colors are supplied from the sub tanks 25 of the respective colors to the heads 24*y* to 24*c*, respectively. The sub tanks 25 are mounted on the carriage 23. The color and number of the ink may be arbitrary and may be changed as necessary.

The ink of each colors of the sub tank 25 is supplied from the ink cartridges 26*k*, 26*w*, 26*c*, 26*m*, and 26*y*. Hereinafter, the ink cartridges 26*k*, 26*w*, 26*c*, 26*m*, and 26*y* may be collectively referred to as the "ink cartridge 26". The ink cartridges 26*k*, 26*w*, 26*c*, 26*m*, and 26*y* are liquid cartridges contain black (Bk) ink, white (W) ink, cyan (C) ink, magenta (M) ink, and yellow (Y) ink, respectively. The ink cartridge 26 is detachably mounted on a cartridge mounting portion provided on a front side of an apparatus body 1*a* of the inkjet printer 1 as illustrated in FIG. 1. The ink cartridge 26 is schematically illustrated in FIG. 1. Thus, ratio of size between the sub tank 25 and the ink cartridge illustrated in FIG. 1 is different from actual ratio of size between the sub tank 25 and the ink cartridge 26.

The ink droplets (liquid droplets) of each color are cured by being irradiated with active energy rays of the irradiator 55. An ultraviolet-ray, an electron beam, etc. may be used as the active energy ray for example. The ultraviolet-ray is most preferable among the above-described active energy rays.

A configuration of irradiator 55 to irradiate active energy rays is described below.

As illustrated in FIG. 2, the carriage 23 scans in the main scanning direction Y1, and the sheet 5 is conveyed in a sub-scanning direction indicated by arrow Y2. Here, the main scanning direction Y1 is a first direction, and the sub-scanning direction Y2 is a second direction. The main scanning direction Y1 is perpendicular to the sub-scanning direction Y2. The irradiator 55 includes UV lamps 51 and 52 disposed on both sides of the head 24. The UV lamp 51 is disposed backward (upper side in FIG. 2) in scanning direction of the main scanning direction Y1 of the head 24 (carriage 23). The UV lamp 52 is disposed forward (lower side in FIG. 2) in scanning direction of the main scanning direction Y1 of the head 24 (carriage 23).

The UV lamps 51 and 52 irradiate active energy rays to an active-energy ray curable ink discharged from the head 24. An ultraviolet lamp unit (UV lamp) is described as an example of the irradiator 55, and ultraviolet light is described as an example of the active energy ray in the present disclosure. However, the irradiator 55 and the active energy ray according to the present disclosure are not limited to the embodiments as described above.

Irradiation of the ultraviolet light on the liquid droplets (ink droplets) discharged onto the sheet 5 cures and fixes the ink on the sheet 5.

As illustrated in FIG. 1, the inkjet printer 1 includes an image forming unit 2, a sub-scanning conveyor 3, and the like inside the apparatus body 1*a* (interior of housing) of the inkjet printer 1. The sheets 5 are fed one by one from the sheet feeder 4 on a right side of the apparatus body 1*a*, and are conveyed to the conveyance path 305 of the sub-scanning conveyor 3 via the conveyance path 310. The head 24 of the image forming unit 2 discharges ink while the carriage 23 reciprocally moves in the main scanning direction Y1 when the sub-scanning conveyor 3 conveys the sheet 5 so that an image is formed (recorded) on the sheet 5. A recorded material (sheet 5 on which an image is formed) is ejected onto the ejection tray 104 provided on a left side of the apparatus body 1*a* via the conveyance path 306. An image forming process including order of forming images of the inkjet printer 1 is described below.

The carriage 23 holding the head 24 is movably held by a guide rod 22 and a guide stay in the main scanning direction Y1. A main scanning motor 27 moves and scans the carriage 23 in the main scanning direction Y1 via a timing belt 29 bridged between a driving pulley 28A and a driven pulley 28B. The carriage 23, the guide rod 22, the main scanning motor 27, the driving pulley 28A and the driven pulley 28B, and the timing belt 29 form a main scan moving unit 31 (see FIG. 9).

Further, the carriage 23 can adjust a distance between the head 24 and the sheet 5 in the vertical direction according to a number of layers of a target image, that is, a thickness of a liquid layer. Here, "the number of layers" is a number of layers of the liquid layers when a new liquid layer is laminated on a previously formed liquid layer.

Further, the UV lamps 51 and 52 are engaged with the carriage 23 by a ball screw rod 53 and 54 screwed in a spiral shape. The UV lamps 51 and 52 are movable along the ball screw rod 53 and 54 and are disposed at a predetermined distance from the head 24, respectively.

The UV lamps 51 and 52 move in the main scanning direction Y1 with the carriage 23 while a predetermined distance is provided between each of the UV lamps 51 and 52 and the carriage 23. The inkjet printer 1 according to the present disclosure performs UV curing by a shuttle method. That is, the inkjet printer 1 moves the carriage 23 in the main scanning direction Y1 and discharges liquid droplets (ink droplets) from the head 24 mounted on the carriage 23 while the sub-scanning conveyor 3 feeds the sheet 5 in a sheet conveyance direction (sub-scanning direction Y2). At the same time, the UV lamps 51 and 52 mounted on the carriage 23 of the inkjet printer 1 irradiates ultraviolet rays on the ink to cure the ink to form an image.

The head 24 is driven by, for example, a piezo-type driving system. In the piezo-type driving system, a piezoelectric element 244 is used as a pressure generator (actuator) to press the ink in an ink channel (pressure chamber 243) in the head 24 (see FIGS. 6A and 6B). The head 24 causes the piezoelectric element 244 to deform a diaphragm 245 that forms a wall of the ink channel (pressure chamber 243), and causes an inner volume of the ink channel (pressure chamber 243) to be changed to discharge liquid droplets from the nozzle N (see FIGS. 6A and 6B).

The driving system of the head 24 is not limited to the piezo-type driving system, and may be any driving system. The driving system of the head 24 may be, for example, an electrostatic driving system. The head 24 using the electrostatic driving system includes an electrode and a diaphragm forming a wall of an ink channel (pressure chamber) disposed opposite to each other. The head 24 using the electrostatic driving system deforms the diaphragm by an electrostatic force generated between the diaphragm and the electrode, thereby changing the volume of the ink channel (pressure chamber) to discharge the ink droplet (liquid droplet) from the nozzle N. The head 24 according to the present disclosure includes a head heater 30 (see FIG. 4B) as a heater to heat the ink (liquid) in the head 24 to a predetermined temperature to decrease viscosity of the ink (liquid) so that the ink becomes dischargeable from the nozzle N. Thus, the head 24 can discharge the ink (liquid) from the nozzle N.

As illustrated in FIG. 2, the inkjet printer 1 includes a maintenance unit 121 to maintain and recover a discharge function of the nozzle N of the head 24. The maintenance unit 121 is disposed in a non-printing area of the inkjet printer 1 on one side (back side or upper side in FIG. 2) of the carriage 23 in the main scanning direction Y1. The maintenance unit 121 includes moisture-retention caps 122*y*, 122*m*, 122*k*, 122*w*, 122*c*, a wiper 124, a suction cap 125, and the like.

The moisture-retention caps 122*y*, 122*m*, 122*k*, 122*w* and 122*c* cap the nozzle surfaces 246 of the heads 24*y*, 24*m*, 24*k*, 24*w* and 24*c*, respectively. The wiper 124 wipes the nozzle surfaces 246 of the five heads 24*y*, 24*m*, 24*k*, 24*w* and 24*c*. The suction cap 125 sucks ink from the nozzles N on the nozzle surface 246 and recovers nozzles N that do not discharge ink or abnormally discharge ink. The suction cap 125 includes a suction motor to suck ink (liquid) from the nozzle N on the nozzle surface 246.

Further, the inkjet printer 1 includes a dummy discharge receptacle 126 in the non-printing area on another side (front side or lower side in FIG. 2) of the carriage 23 in the scanning direction Y1. The dummy discharge receptacle receives the ink discharged from five heads 24*y*, 24*m*, 24*k*, 24*w*, and 24*c* as a dummy discharge operation that discharges the ink that does not contribute to printing (image formation). The dummy discharge receptacle 126 includes five openings 127*y*, 127*m*, 127*k*, 127*w*, and 127*c* formed corresponding to the five heads 24*y*, 24*m*, 24*k*, 24*w*, and 24*c*.

The dummy discharge receptacle 126 is a portion other than the medium to which a liquid discharged by the dummy discharge operation after the discharge operation.

The inkjet printer 1 may include a maintenance unit 121 to maintain each of the heads 24*y*, 24*m*, 24*k*, 24*w*, and 24*c* on the carriage 23 as necessary. In this case, the inkjet printer 1 may include a waste liquid tank to collect waste liquid discharged after a maintenance operation.

FIG. 3 illustrates a tension roller 15, ejection rollers 16 and 17, and a conveyance roller 19 illustrated in FIG. 1. FIG. 3 illustrates an example of the sub-scanning conveyor 3 of the inkjet printer 1 according to the present disclosure.

Specifically, FIG. 3 is a schematic side view of an example of the sub-scanning conveyor 3 of the inkjet printer 1 according to the present disclosure.

The sub-scanning conveyor 3 includes a conveyance belt 13 that attracts and conveys the sheet 5 to a position facing the image forming unit 2. The conveyance belt 13 is stretched between the conveyance roller 19 and a driven roller 21. A tension is applied on the conveyance belt 13 by the tension roller 15 to maintain an appropriate tension on the conveyance belt 13.

The tension roller 15 is held by an arm 37*b*. The arm 37*b* is rotatable around a rotation fulcrum 37*a* as a fulcrum. Thus, the tension roller 15 is moved (rotated) in a direction indicated by arrow as illustrated in FIG. 3 to adjust tension of the conveyance belt 13, for example.

The inkjet printer 1 includes a sub-scanning motor 131 that rotates the conveyance roller 19 to rotate the conveyance belt 13. An arrangement position (vertical position, for example) of the driven roller 21 is variable. If necessary, a position of the driven roller 21 may be lowered to lower a conveyance surface formed by the conveyance roller 19 and the driven roller 21 by a distance "a" as illustrated in FIG. 3. The inkjet printer 1 includes a platen 40 that guides the conveyance belt 13 in a region facing the image forming unit 2 and is disposed to maintain appropriate flatness.

The conveyance belt 13 preferably has a two-layer structure including a front layer and a back layer, for example. The front layer is a medium-resistance layer which is a sheet suction surface formed of a pure resin material not subjected to resistance control. A pure resin material not subjected to resistance control is, for example, an ethylene tetrafluoroethylene (ETFE) pure material. The back layer is an earth layer formed of the same material as the front layer and subjected to resistance control by carbon. The conveyance belt 13 may have a single layer structure or a three or more-layer structure.

The inkjet printer 1 includes a pressure roller 38 to press the sheet 5 against the conveyance belt 13 at a position facing the conveyance roller 19 on an upstream side (right side in FIG. 3) of the sub-scanning conveyor 3. The pressure roller 38 presses the sheet 5 against the conveyance belt 13 so that the sheet 5 is in close contact with the conveyance belt 13. Further, the sheet 5 is attracted to the conveyance belt 13 by electrostatic force. Further, the inkjet printer 1 includes a charging roller 18 disposed upstream side (right side in FIG. 3) of the pressure roller 38 in a circumferential direction of the conveyance belt 13 to charge a surface of the conveyance belt 13. A direct voltage or a high-voltage of the direct voltage to which an alternating voltage is superimposed is supplied to the charging roller 18 from a high-voltage power supply to charge the charging roller 18. The high-voltage power supply is a power supply unit to supply a direct current (DC) or a superimposed bias supply unit of direct current (DC) or alternating current (AC).

The inkjet printer 1 includes a sheet ejection mechanism that includes ejection rollers 16 and 17, and the ejection tray 104 on a downstream side (left side in FIG. 3) of the sub-scanning conveyor 3. The ejection roller 16 conveys to eject the sheet 5 to the ejection tray 104. The ejection roller 17 presses the sheet 5 against the ejection roller 16. The ejection tray 104 stocks the ejected sheet 5.

An example of a configuration of a controller 200 of the inkjet printer 1 according to the present disclosure is described with reference to FIG. 4.

Figure 4A:
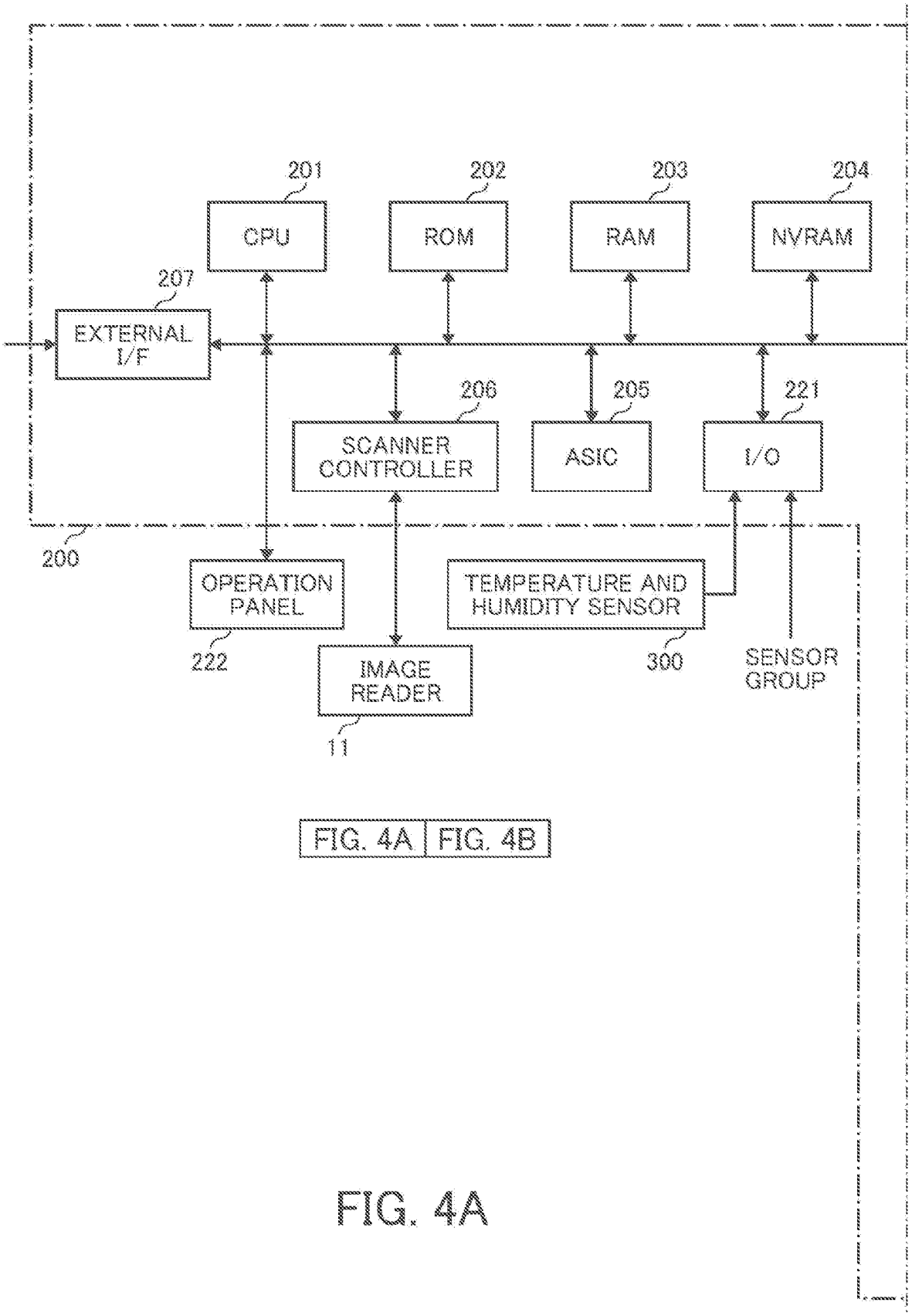
FIGS. 4A and 4B are a circuit diagram of an example of a controller of the inkjet printer.
Figure 4B:
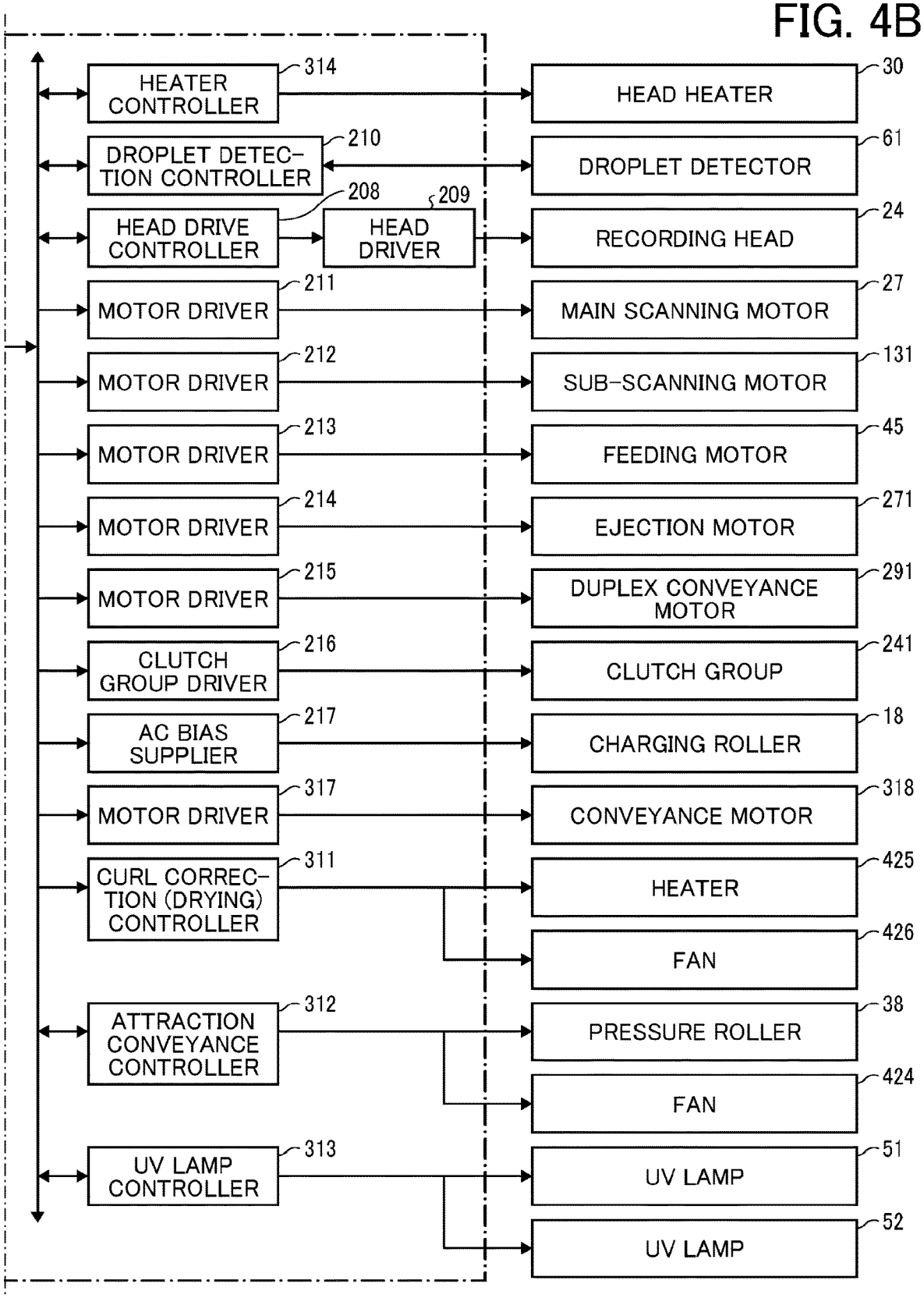

FIGS. 4A and 4B are block diagrams of an example of a configuration of the controller 200 of the inkjet printer 1 according to the present disclosure.

The controller 200 of the inkjet printer 1 according to the present disclosure includes a central processing unit 201 (CPU 201), a read only memory 202 (ROM 202), a random access memory 203 (RAM 203), a non-volatile random access memory 204 (NVRAM 204), an application specific integrated circuit 205 (ASIC 205), a scanner controller 206, an external interface 207 (external I/F 207), a head drive controller 208, a head driver 209, a droplet detection controller 210, motor drivers 211 to 215, a clutch group drivers 216, an alternating current bias supplier 217 (AC bias supplier 217), an input/output 221 (I/O 221), a motor driver 317, a curl correction (drying) controller 311, an attraction conveyance controller 312, a UV lamp controller 313, and a heater controller 314.

The functions of the controller 200 may be implemented by one or more processing circuits or circuitry such as the central processing unit 201 (CPU 201). Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The controller 200 is electrically connected to an operation panel 222, an image reader 11, a sensor group such as a temperature and humidity sensor 300, the head 24, a droplet detector 61, a main scanning motor 27, a sub-scanning motor 131, a feeding motor 45, an ejection motor 271, a duplex conveyance motor 291, a clutch group 241, the charging roller 18, the conveyance motor 318, the heater 425, the fan 426, the pressure roller 38, the fan 424, and the UV lamps 51 and 52.

The central processing unit 201 (CPU 201) executes programs to control operations of the inkjet printer 1. The ROM 202 stores programs, drive waveform data, and other fixed data. The RAM 203 temporarily stores image data and the like. The NVRAM 204 is a non-volatile memory that stores data that needs to be held even while the power of the inkjet printer 1 is shut off. The ASIC 205 performs various types of signal processing on image data, image processing such as reordering, and other input/output signal processing to control the entire apparatus. The external IN 207 exchanges data and signals with an external device.

A head drive controller 208 and a head driver 209 drive and control the head 24 of the image forming unit 2. The droplet detection controller 210 drives and controls the droplet detector 61. The motor driver 211 drives and controls the main scanning motor 27. The motor driver 212 drives and controls the sub-scanning motor 131. The motor driver 213 drives and controls the feeding motor 45. The motor driver 214 drives and controls the ejection motor 271. The motor driver 215 drives and controls the duplex conveyance motor 291.

The AC bias supplier 217 applies an AC bias to the charging roller 18 to drive and control the charging roller 18. The I/O 221 receives detection signal from sensors such as a temperature and humidity sensor 300 that detects an environmental temperature and an environmental humidity (any one of the environmental temperature and the environmental humidity may be used), an encoder that outputs a detection signal according to an amount of movement and moving speed of the conveyance belt 13, and other sensor group. The operation panel 222 is an operation unit that includes a Liquid Crystal Display (LCD) that inputs and outputs information, for example.

The motor driver 317 drives and controls the conveyance motor 318 that conveys the sheet 5. The curl correction (drying) controller 311 controls the heater 425 and the fan 426 used for the curl correction (drying) process. The attraction conveyance controller 312 controls the pressure roller 38 and the fan 424 used for an attraction conveyance process. The UV lamp controller 313 controls lighting of the UV lamps 51 and 52. The heater controller 314 controls turning ON and turning OFF of the head heater 30 in the head 24. The heater controller 314 performs feedback control based on a detection result of the temperature and humidity sensor 300 in the head 24 to maintain the temperature of the ink in the head 24 to be within a predetermined temperature range.

Next, a flow of an operation of the controller 200 is described below.

First, the external I/F 207 receives print data, for example, through wired communication or wireless communication from an information processing apparatus such as a personal computer, an image reader such as an image scanner, and a host side apparatus such as an imaging apparatus such as a digital camera. An image reader may be, for example, the image reader 11 controlled by the scanner controller 206. The print data is described as lamination data indicating information of each layers to be laminated in the present disclosure to describe the process of forming an image by lamination of the ink.

The CPU 201 of the controller 200 reads out print data from a receive buffer in the external I/F 207 and analyzes the print data. Further, the CPU 201 performs necessary image processing, data rearrangement processing, and the like by the ASIC 205. Then, the CPU 201 generates dot pattern data from the image data of each layer processed by the ASIC 205. Dot pattern data corresponding to one scanning by the head 24 is transmitted to the head drive controller 208 in synchronization with the clock signal. The one scanning by the head 24 is one movement to moving the carriage 23 forward or backward in the main scanning direction Y1.

The heater controller 314 turns on an energization of the head heater 30 in the head 24 to heat the ink in the head 24 to control the temperature of the ink to be within a predetermined temperature range. Thus, the heater controller 314 reduces viscosity of the ink to a viscosity dischargeable from the nozzle N. Then, the head drive controller 208 selectively drives the piezoelectric element 244 through the head driver 209 in synchronization with the scanning of the head 24 to discharge a liquid from the nozzle N corresponding to the dot pattern corresponding to one scan by the head 24. Specifically, the head drive controller 208 outputs a drive waveform to the head driver 209, and turns on a selection switch of the piezoelectric element 244 of the nozzle N corresponding to the dot pattern to drive the piezoelectric element 244 of the nozzle N corresponding to the dot pattern with a voltage of the drive waveform.

Further, the head drive controller 208 transfers a command of the droplet detection issued from the CPU 201 to the droplet detection controller 210. The droplet detection controller 210 controls the droplet detector 61 according to the timing of the command. The droplet detector 61 detects a discharge state of liquid droplets from the head 24 through a light emitter, a light receiver, and an optical axis deflector. The droplet detector 61 transfers detection data obtained based on detection result to the CPU 201 via the droplet detection controller 210.

The CPU 201 transmits irradiation data to the UV lamp controller 313 based on the detection data. The UV lamp controller 313 drives the UV lamps 51 and 52 based on irradiation data to irradiate ultraviolet light on the liquid droplets on the sheet 5. Thus, the ultraviolet curable ink (active-energy ray curable ink) discharged from the head 24 onto the sheet 5 is cured. Thus, an image is formed (recorded) on the sheet 5.

The sheets 5 are fed one by one from the sheet feeder 4 in the inkjet printer 1 configured as described above. The sheet 5 is pressed against the conveyance belt 13 by the pressure roller 38 and is conveyed to the platen 40. Then, the sheet 5 is electrostatically attracted to the conveyance belt 13, and is conveyed in the sub-scanning direction Y2 with a circumferential movement of the conveyance belt 13.

While the main scanning motor 27 moves the carriage 23, the head drive controller 208 drives each piezoelectric element 244 of the head 24 based on the image signal (dot pattern data). Thus, the head 24 scans the stopped sheet 5 once, and drives the piezoelectric elements 244, respectively, to discharge the liquid droplets on the sheet 5 during the scanning movement of the head 24 (carriage 23). Thus, a dot pattern for one scan is recorded on the sheet 5. When recording for one scan is completed, the sub-scanning motor 131 rotates the conveyance roller 19 to rotate the conveyance belt 13 to feed the sheet 5 in the sub-scanning direction Y2 by a number of lines corresponding to one scan. Thus, the inkjet printer 1 intermittently conveys the sheet 5 to form an image on the sheet 5.

The CPU 201 ends the recording operation when the CPU 201 receives a recording end signal or a signal indicating that a rear end of the sheet 5 has reached a printing area (recording area). The sheet 5 on which the image is formed is fed to the ejection tray 104 that is a destination of conveyance of the sheet 5.

The above-described embodiment uses the conveyance belt 13 that attracts the sheet 5 with an electrostatic force as a conveyor as an example. However, conveyance belt 13 may include a suction fan to attracts the sheet 5 on the conveyance belt 13. Further, the inkjet printer 1 may convey the sheet 5 to a position facing the image forming unit 2 by the conveyance roller 19 and the pressure roller 38 without using the conveyance belt 13.

Figure 5:
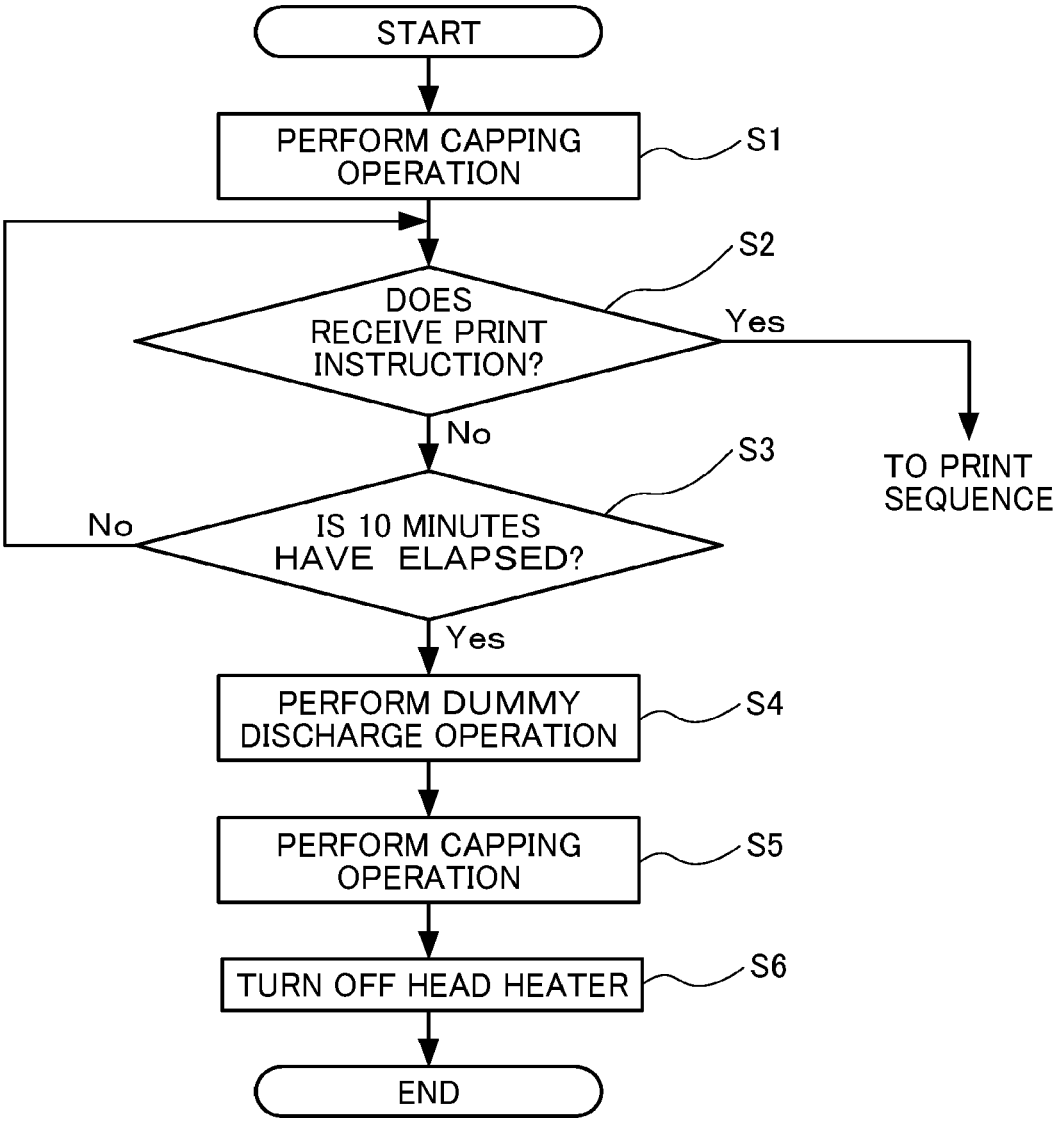
FIG. 5 is a flowchart of a turning-OFF operation of a liquid discharge head immediately after a completion of the image forming operation.

FIG. 5 illustrates a heater control of the head 24 in the inkjet printer 1 according to the present disclosure.

FIG. 5 is a flowchart of a power-off operation of the head 24 immediately after an end of the image forming operation.

The inkjet printer 1 according to the present disclosure shifts to a standby state after a completion of the image forming operation (ink discharge operation for printing). Then, the motor driver 211 drives the main scanning motor 27 to move the carriage 23 in the main scanning direction Y1 to the non-printing area disposed back side in FIG. 2 (upper side in FIG. 2). Then, the moisture-retention caps 122*y*, 122*m*, 122*k*, 122*w*, and 122*c* of the maintenance unit 121 cap the nozzle surfaces 246 of the heads 24*y*, 24*m*, 24*k*, 24*w*, and 24*c* (S1), respectively as a capping operation.

At time of capping the heads 24 with the caps 122 (capping operation, S1), the head heater 30 continues to heat the ink (liquid) in the head 24 to maintain the temperature of the ink in the head 24 within the predetermined temperature range. Thus, when inkjet printer 1 receives input of the next print instruction (instruction of a liquid discharge operation), the inkjet printer 1 can quickly start the image forming operation (printing sequence) because time required for increasing the temperature is shortened (Yes in S2).

After the above-described capping operation (S1) has been completed and if 10 minutes have elapsed without a receipt of an input of the next print instruction (the instruction of the liquid discharge operation) (No in S2 and Yes in S3), the heater controller 314 turns OFF the energization of the head heater 30 (S6) in the present embodiment. If the head heater 30 is continued to be turned ON and left for a predetermined time or more, the ink in the vicinity of the nozzles N may be dried and thickened to cause clogging of the nozzle N such that the thickened ink may not be normally discharged from the nozzle N.

Following problems may occur if the energization of the head heater 30 is turned OFF when the image forming operation (the ink discharge operation for printing) is completed and 10 minutes have elapsed in the standby state after completion of the capping operation.

FIG. 6 is a cross-sectional side view of the head 24 is along a cross-section passing through the nozzle N.

In the head 24, the ink is supplied from a common chamber 242 to the pressure chambers 243 in the ink channel communicating with each nozzles N. The head 24 drives the piezoelectric element 244 to deform the diaphragm 245 that forms a wall of the pressure chamber 243 in the ink channel to cause an inner volume of the pressure chamber 243 to be changed to discharge liquid droplets (ink droplets) from the nozzle N (see FIGS. 6A and 6B).

Figure 6B:
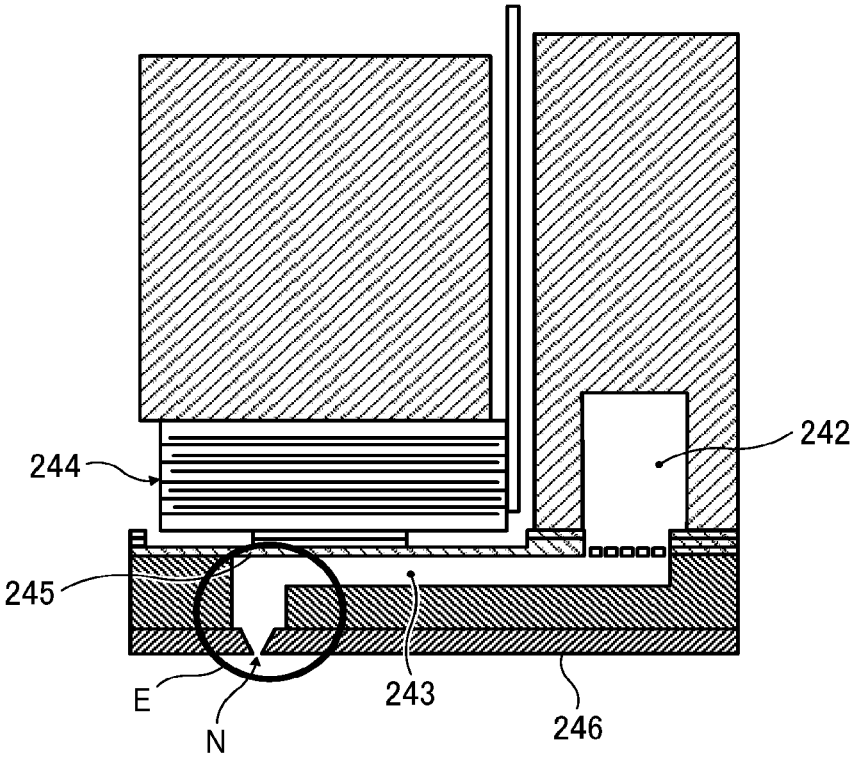

When the energization of the head heater 30 is turned OFF after 10 minutes have elapsed in the standby state, a dried thickened ink that is an ink dried and thickened by heating of the head heater 30 near the nozzle N indicated by "E" in FIG. 6B is diffused inside the head 24. Thus, a region in which the dried thickened ink exists diffuse to a region indicated by "E'" in FIG. 6A. Even if the viscosity of the dried thickened ink is in a degree not to cause clogging of the nozzle N, the dried thickened ink adversely affects the discharge quality of the head 24. Thus, it is desirable to remove the dried thickened ink in the head 24 at time of starting an image forming operation (ink discharge operation) after receipt of the print instruction and transition to a print sequence. If the energization of the head heater 30 is turned OFF after 10 minutes have elapsed in the standby state at the time of starting the image forming operation, an area in which the dried thickened ink exists diffuses as described above. Thus, it is necessary to consume a large amount of ink to remove the dried thickened ink from the head 24.

Therefore, the inkjet printer 1 according to the present disclosure performs a dummy discharge operation (S4 in FIG. 5) that discharges an ink not contributing to an image formation from the head 24 after 10 minutes have elapsed in the standby state and before turning OFF the energization of the head heater 30 (before start of control of stop heating). Hereinafter "control of stop heating" is simply referred to as "heating stop control".

Thus, the inkjet printer 1 performs a dummy discharge operation at a stage in which the energization of the head heater 30 is turned OFF. Thus, the inkjet printer 1 can remove the dried thickened ink in the vicinity of the nozzles N that is thickened by drying due to the heating of the head heater 30. Thus, the inkjet printer 1 can reduce diffusion of the dried thickened ink in the head 24 after turning OFF of an energization of the head heater 30. Therefore, it is sufficient to remove only a small amount of ink existed in a smaller area to remove the dried thickened ink when the image forming process (ink discharge operation) is started after receipt of printing instruction and transition of the print sequence. Thus, the inkjet printer 1 can reduce the amount of ink consumption required to remove the dried thickened ink.

Then, the inkjet printer 1 performs a capping operation (S5) similar to the above-described capping operation in the step S1. Then, the inkjet printer 1 caps the nozzle surfaces 246 of the heads 24*y*, 24*m*, 24*k*, 24*w*, and 24*c* (S1) with the moisture-retention caps 122*y*, 122*m*, 122*k*, 122*w*, and 122*c* of the maintenance unit 121, respectively, as the capping operation. Then, the heater controller 314 turns OFF the energization of the head heater 30 (S6).

The inkjet printer 1 according to the present disclosure consumes ink during the dummy discharge operation in the above-described dummy discharge operation in the step S4. At the time of performing the dummy discharge operation in the step S4 as described above, only approximately 10 minutes have elapsed since the last ink discharge operation. The amount of the dried thickened ink in the vicinity of the nozzle N (an area in which the dried thickened ink exists) is very small at the time of performing the dummy discharge operation in the step S4.

The dried thickened ink is formed by the heating operation of the head heater 30 that dries and thickens the ink. Thus, the amount of ink consumed during the dummy discharge operation in the above-described step S4 is small. Thus, the inkjet printer 1 can reduce an amount of ink consumption required to remove the dried thickened ink even when the dried thickened ink is removed at time of starting the image forming operation (ink discharge operation) after transition to the printing sequence according to the print instruction.

Following describes a nozzle-condition maintenance operation performed after completion of the image forming operation (ink discharge operation) and further the turning OFF of the energization of the head heater 30.

As described above, with turning OFF the energization of the head heater 30 after 10 minutes have elapsed in the standby state, a speed of thickening of ink in the vicinity of the nozzles N is reduced compare than a speed of thickening of ink when the ink is continuously heated. However, thickening of ink still gradually progresses. If the viscosity of ink continues to increase, clogging of the nozzles N may occur in which the ink in the vicinity of the nozzles N becomes too thick due to drying so that the dried thickened ink may not be discharged from the nozzles N.

When the clogging occurs, the head 24 cannot even discharge the dried thickened ink (dummy discharge) in the dummy discharge operation. Thus, the suction cap 125 of the inkjet printer 1 has to suck the dried thickened ink from the nozzles N on the nozzle surface 246 to forcibly discharge the dried thickened ink. The operation of forcibly discharge the dried thickened ink by the suction cap 125 is also referred to as a "forced suction operation". In the forced suction operation by the suction cap 125, the inkjet printer 1 according to the present embodiment has to consume 2 cc of ink per head, for example. After the suction cap 125 sucks 2 cc of ink from the nozzles N, the wiper 124 wipes and cleans the nozzle surface 246 of the head 24. Then, ink meniscus is formed in the nozzles N to be ready for the next discharge operation.

Following describes the reason why the suction cap 125 has to consume as much as 2 cc of ink per head in the forced suction operation. The suction cap 125 has to suck the entire nozzles N at one time to recover the nozzles N that is clogged by the dried thickened ink so that the head 24 cannot discharge the ink from the nozzles N. Thus, a large amount of ink is discharged from other normal nozzles N that can discharge the ink while the suction cap 125 forcibly suctions the ink until the dried thickened ink is exhausted from the nozzles N that cannot discharge the dried thickened ink. Therefore, the forced suction operation consumes a large amount of ink of 2 cc per head.

Thus, it is important not to perform the forced suction operation of the ink by the suction cap 125 as much as possible to reduce ink consumption. To prevent the forced suction operation, the viscosity of the ink in the nozzles N has to be maintained in a range not to clog the nozzles N by the dried thickened ink such that the ink cannot be discharged from the nozzles N.

Figure 7:
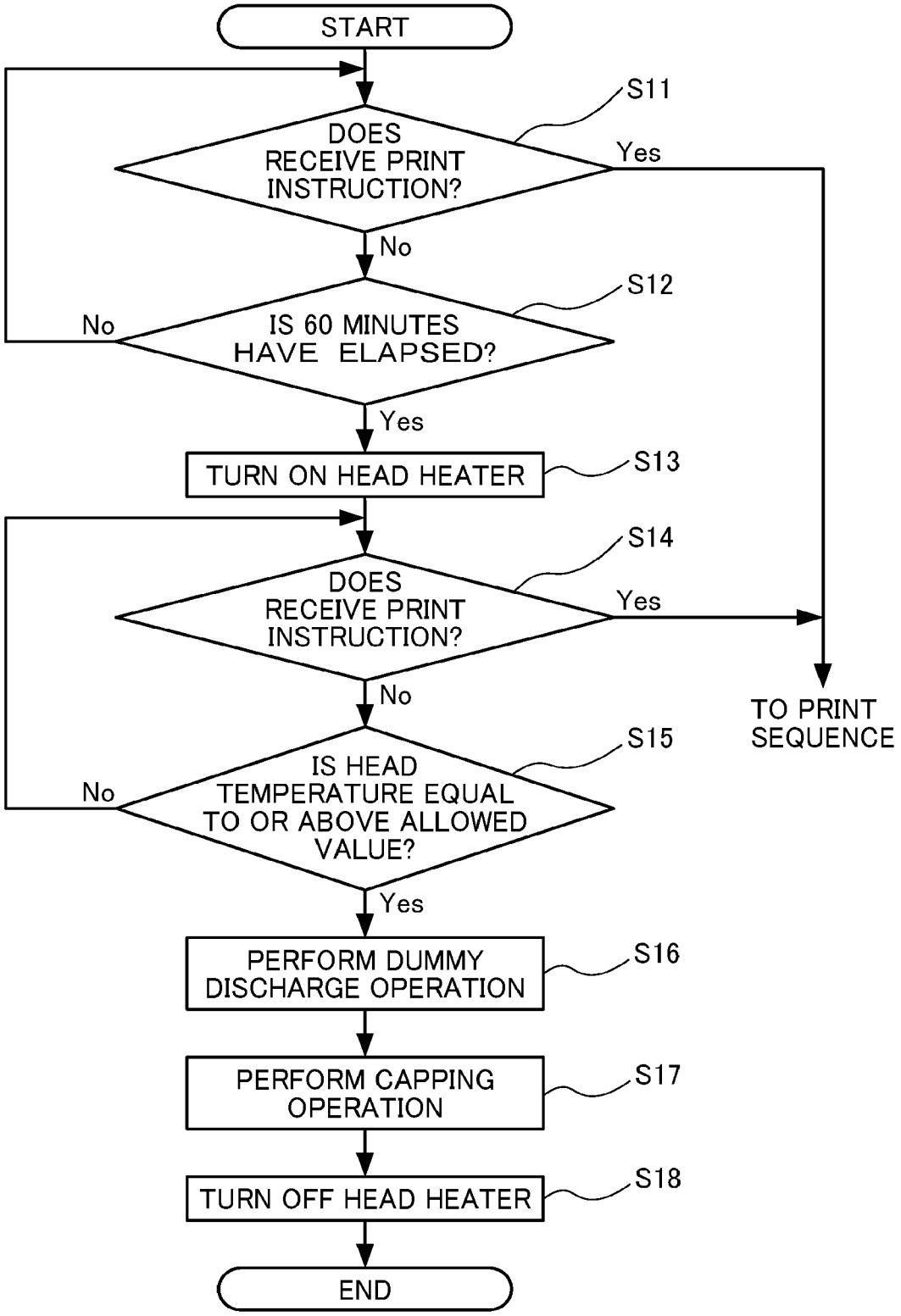
FIG. 7 is a flow chart of a nozzle-condition maintenance operation performed after a completion of the image forming operation and turning OFF of an energization of the head heater.

FIG. 7 is a flow chart of the nozzle-condition maintenance operation performed after the completion of the image forming operation and turning OFF of the energization of the head heater 30.

In the inkjet printer 1 according to the present embodiment, the heater controller 314 (S13) turns ON the energization of the head heater 30 when 60 minutes have elapsed without input (receipt) of a next print instruction from the time at which the energization of the head heater 30 is turned OFF in the standby state (No in S11 and Yes in S12). The next print instruction is a next instruction to perform the liquid discharge operation. Thus, the temperature of the ink in the head 24 is heated to be within a predetermined temperature range, and the viscosity of ink is reduced to become the viscosity that can be discharged from the nozzles N.

If the next print instruction (instruction of liquid discharge operation) is not input (No in S14), and the head temperature indicated by the temperature and humidity sensor 300 in the head 24 becomes equal to or above an allowable value (Yes in S15), the inkjet printer 1 determines that temperature of the ink in the head 24 is raised to a predetermined temperature range, and performs the dummy discharge operation (S16). Thus, the inkjet printer 1 discharges the ink, the viscosity of which has increased by drying during the time elapsed since previous dummy discharge operation. Thus, the inkjet printer 1 can maintain the viscosity of the ink in the head 24 within an appropriate range.

As described above, if energization of the head heater 30 is kept turned ON without turning OFF the energization of the head heater 30 at time of completion of the image forming operation (ink discharge operation for printing) and 10 minutes have passed in the standby state, it is necessary to repeatedly perform the dummy discharge operation at 10 minute intervals to maintain the viscosity of ink to prevent discharge failure due to the clogging by the dried thickened ink.

Conversely, the inkjet printer according to the present embodiment turns OFF the energization of the head heater 30 at the time of completion of the image forming operation (ink discharge operation for printing) and 10 minutes have elapsed in the standby state. Then, the inkjet printer 1 merely repeatedly performs the dummy discharge operation at intervals of 60 minutes to maintain the viscosity of the ink.

In the above-described dummy discharge operation, substantially equal amount of ink is discharged from all the nozzles since the nozzles are not clogged. Therefore, there are no nozzles that uselessly discharges ink when a required amount of ink is discharged from all nozzles in the head 24. The amount of ink consumed during the dummy discharge operation is much smaller than the amount of ink consumed during the forced suction operation. For example, the inkjet printer 1 according to the present embodiment consume 0.2 cc of ink by one dummy discharge operation. The amount of ink consumed by the dummy discharge operation is reduced a fraction of or one-tenth of an amount of ink consumed by the forced suction operation.

Following describes a relation between number of droplets (ink droplets) necessary for maintaining a normal discharge operation by the dummy discharge operation (number of dummy discharge droplets) and waiting time after completion of the ink discharge operation.

Figure 8:
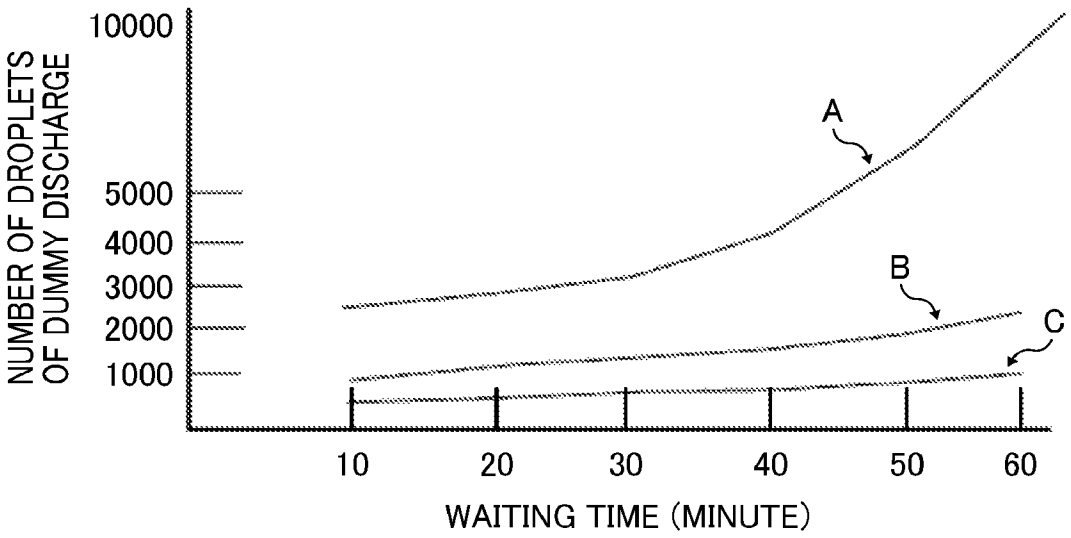
FIG. 8 is a graph illustrating a relation between waiting time and a required number of dummy discharge droplets in cases A to C.

FIG. 8 is a graph illustrating a relation between the waiting time and the required number of dummy discharge droplets for cases A to C.

In a case A, the energization of the head heater 30 is turned OFF without performing the dummy discharge operation after 10 minutes have elapsed while the energization of the head heater 30 is turned ON after completion of the image forming operation (ink discharge operation). In the case A, when the waiting time after the completion of the ink discharge operation has passed 60 minutes, the number of dummy discharge droplets required for enabling a normal discharge is 10000 droplets per head.

In a case B, the energization of the head heater 30 is turned OFF after performing the dummy discharge operation after 10 minutes have elapsed while the energization of the head heater 30 is turned ON after completion of the image forming operation (ink discharge operation). The number of dummy discharge droplets in the dummy discharge operation was set to one thousand (1000). In the case B, when the waiting time after the completion of the ink discharge operation has passed 60 minutes, the number of dummy discharge droplets required for enabling the normal discharge is 2000 droplets per head.

Thus, the dummy discharge operation is performed before turning OFF the energization of the head heater 30 after 10 minutes have elapsed while the energization of the head heater 30 is turned ON in the case B. Therefore, the case B can reduce the ink consumption of 7000 drops per head in total compared to the case A in which the energization of the head heater 30 is turned OFF without performing the dummy discharge operation.

In a case C, the dummy discharge operation (500 droplets per head) is performed immediately after the completion of the image forming operation (ink discharge operation). Then, the energization of the head heater 30 is turned OFF after performing the dummy discharge operation (1000 drops per head) after 10 minutes have elapsed while the energization of the head heater 30 is turned ON.

Thus, the case C performs two types of dummy discharge operations (500 droplets per head and 1000 droplets per head) after the completion of the image forming operation while turning ON the energization of the head heater 30 before turning OFF the energization of the head heater 30. The first type of the dummy discharge operation (500 droplets per head) is also referred to as the "first dummy discharge operation". The second type of the dummy discharge operation (1000 droplets per head) is also referred to as the "second dummy discharge operation".

In the case C, when the waiting time after the completion of the ink discharge operation has passed 60 minutes, the number of dummy discharge droplets required for enabling the normal discharge is 1000 droplets per head. Therefore, the case C can reduce the ink consumption of 7500 drops per head in total compared to the case A in which the energization of the head heater 30 is turned OFF without performing the dummy discharge operation. Further, the case C can reduce the ink consumption of 500 drops per head in total compared to the case B in which the energization of the head heater 30 is turned OFF after performing only one type of the dummy discharge operation of 1000 drops per head.

In the present disclosure, the "liquid discharge apparatus" includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, ceramic, construction materials (e.g., wall paper or floor material), and cloth textile.

Further, the term "liquid" includes any liquid having a viscosity or a surface tension that can be discharged from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. Specifically, "liquid" includes ink, treatment liquid, DNA sample, resist, pattern material, binding agent, modeling solution, or solution and dispersion containing amino acid, protein, calcium and the like.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

The "liquid discharge head" is a functional component that discharges and jets the liquid from the nozzle. Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, and a main scan moving unit.

Here, examples of the single unit include a combination in which the head and a functional part(s) are secured to each other through, e.g., fastening, bonding, or engaging, and a combination in which one of the head and a functional part(s) is movably held by another. The head may be detachably attached to the functional part(s) or unit(s) s each other.

For example, as a liquid discharge device, there is a liquid discharge device in which the head 24 and the sub tank 25 form a single unit as in the above-described embodiments. Alternatively, the head 24 and the sub tank 25 coupled (connected) with a tube or the like may form a single unit. A unit including a filter can be added at a position between the sub tank 25 and the head 24 of the liquid discharge device.

The head 24 and the carriage 23 may form the "liquid discharge device" as a single unit as above-described embodiments.

Figure 9:
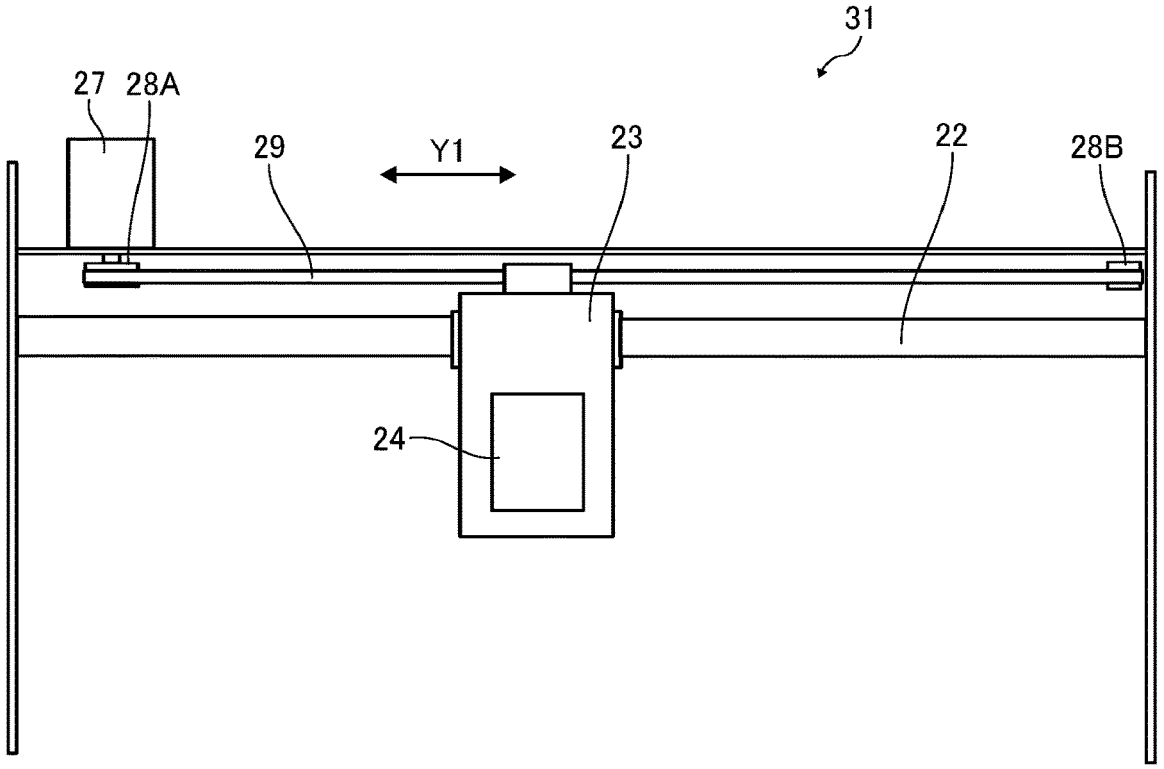
FIG. 9 is a front view of a portion of an example of a liquid discharge device.

In still another example, the liquid discharge device includes the head 24 movably held by a guide that forms part of a main scan moving unit 31 (see FIG. 9), so that the head 24 and the main scan moving unit 31 form a single unit. The head 24, the carriage 23, and the main scan moving unit 31 may form a single unit as a liquid discharge device as illustrated in FIG. 9.

In still another example, a cap that forms part of a maintenance unit may be secured to the carriage 23 mounting the head 24 so that the head 24, the carriage 23, and the maintenance unit form a single unit to form the liquid discharge device.

Figure 10:
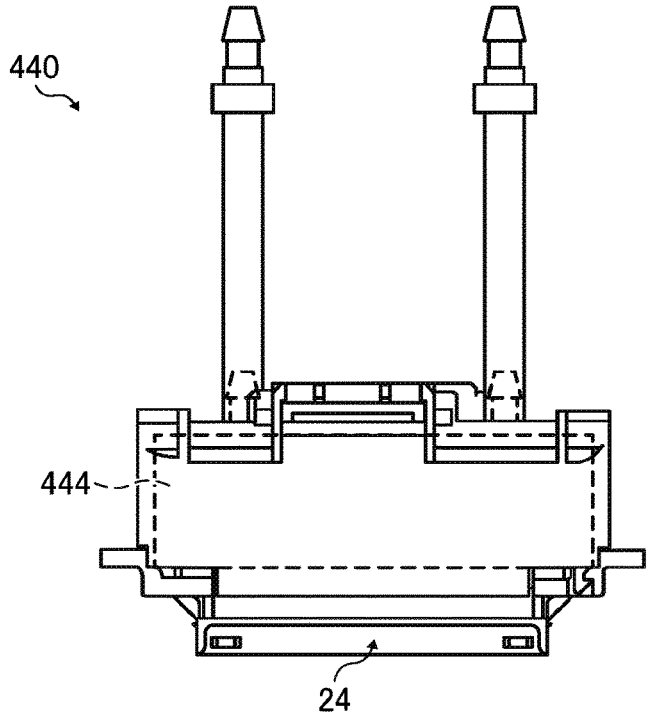
FIG. 10 is a front view of still another example of the liquid discharge device.

Like the liquid discharge device 440 illustrated in FIG. 10, the head 24 and a supply unit form a single unit to form the liquid discharge device 440 in which the tube is connected to the head 24 mounting the sub tank 25 or the channel part 444.

The main scan moving unit 31 may be a guide only. The supply unit may be a tube(s) only or a loading unit only.

The terms "image formation", "recording", "printing", "image printing", and "fabricating" used herein may be used synonymously with each other.

The above-described embodiments are limited examples, and the present disclosure includes, for example, the following aspects having advantageous effects.

[Aspect A]

A liquid discharge apparatus includes a liquid discharge head configured to discharge a liquid to a medium, a heater configured to heat the liquid in the liquid discharge head, and circuitry configured to cause the liquid discharge head to discharge the liquid heated by the heater to the medium as a discharge operation, cause the liquid discharge head to discharge the liquid heated by the heater to a portion other than the medium as a dummy discharge operation after the discharge operation, and cause the heater to stop heating the liquid in the liquid discharge head after the dummy discharge operation.

According to the aspect A, after the discharge operation of the liquid heated by the heating unit is finished and the standby state is established, the heating by the head heater 30 is stopped. Thus, the aspect A can reduce thickening of the liquid due to drying of the liquid in the vicinity of the nozzles and reduce clogging of the nozzles compared to the case in which the head heater 30 continues to heat the liquid during the standby state.

The liquid in the vicinity of the nozzles thickened by drying due to heating (dried thickened liquid) diffuses in the liquid discharge head if the heating of the heater is simply stopped after the standby state. Thus, the area in which the dried thickened liquid exists diffuses. Even if the viscosity of the dried thickened liquid is low enough not to cause clogging, the dried thickened liquid has an adverse effect on the discharge quality of the liquid discharge head. Thus, it is preferable to remove the dried thickened liquid from the liquid discharge head when the liquid discharge operation is started after the standby state.

To remove the dried thickened liquid at the time of liquid discharge operation, it is necessary to integrally remove the entire liquid in a region in which the dried thickened liquid exists. The entire liquid includes a liquid having a viscosity within an appropriate range. If the dried thickened liquid diffuses and exists in a wide area in the liquid discharge head as described above, a large amount of liquid should be consumed to remove the dried thickened liquid.

Thus, the aspect A performs the dummy discharge operation to discharge the liquid not contributing the image formation from the liquid discharge head before stopping the heating of the heater after entering the standby state. Thus, the aspect A can perform the dummy discharge operation to remove the dried thickened liquid in the vicinity of the nozzles thickened by the drying due to heating of the heater in a stage of stop heating of the heater.

Thus, the aspect A can prevent the diffusion of the dried thickened liquid after stopping the heating of the heater. Thus, it is necessary to remove only the liquid in a narrower region to remove the dried thickened liquid in the aspect A when the standby state is finished, and the liquid discharge operation is to be started. Thus, the aspect A can reduce an amount of liquid consumed to remove the dried thickened liquid even if an amount of liquid consumed during the dummy discharge operation is added.

[Aspect B]

In the liquid discharge apparatus according to the aspect A, the circuitry performs the discharge operation, waits for a predetermined time while heating the liquid in the liquid discharge head by the heater without performing the discharge operation, perform the dummy discharge operation after the predetermine time has elapsed, and cause the heater to stop heating the liquid in the liquid discharge head after the dummy discharge operation.

The aspect B stops the heating of the heater after a predetermined time has elapsed while the energization of the heater is kept tuned ON in the standby state. Thus, the aspect B can remove the dried thickened liquid in the vicinity of the nozzles thickened by the drying due to heating by the dummy discharge operation at time of stopping the heating by the heater.

Thus, the aspect A can prevent the diffusion of the dried thickened liquid after stopping the heating of the heater. Thus, it is necessary to remove only the liquid in a narrower region to remove the dried thickened liquid in the aspect B when the standby state is finished, and the liquid discharge operation is to be started. Thus, the aspect B can reduce an amount of liquid consumed to remove the dried thickened liquid even if an amount of liquid consumed during the dummy discharge operation is added.

[Aspect C]

In the liquid discharge apparatus according to the aspect A, the circuitry performs the discharge operation, performs the dummy discharge operation after the discharge operation as a first dummy discharge operation, waits for a predetermined time while heating the liquid in the liquid discharge head by the heater without performing the discharge operation, perform the dummy discharge operation after the predetermine time has elapsed as a second dummy discharge operation, and cause the heater to stop heating the liquid in the liquid discharge head after the second dummy discharge operation.

The aspect C can further reduce the liquid consumption required to remove the dried thickened liquid as in the above-described case B.

[Aspect D]

In the liquid discharge apparatus according to the aspect C, an amount of the liquid discharged by the first dummy discharge operation is smaller than an amount of the liquid discharged by the second dummy discharge operation.

The aspect D can further reduce the liquid consumption required to remove the dried thickened liquid as in the above-described case B.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

"The liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a main scan moving unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank are integrated as the liquid discharge device. The head and the head tank may be connected each other via, e.g., a tube to integrally form the liquid discharge device. Here, a unit including a filter may further be added to a portion between the head tank and the head.

The liquid discharge device may be an integrated unit in which a head is integrated with a carriage.

The liquid discharge device may be the head movably held by a guide that forms part of a main scan moving unit, so that the head and the main scan moving unit are integrated as a single unit. The liquid discharge device may include the head, the carriage, and the main scan moving unit that are integrated as a single unit.

In another example, the cap that forms part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The main scan moving unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus, comprising:

a liquid discharge head comprising an actuator configured to discharge a liquid to a medium;

a heater configured to heat the liquid in the liquid discharge head; and circuitry configured to:

cause the heater to heat the liquid in the liquid discharge head;

cause the liquid discharge head to discharge the liquid being heated by the heater to the medium as a discharge operation;

wait a predetermined time after the discharge of the liquid to the medium, while continuously heating the liquid in the liquid discharge head;

in response to the predetermined time having elapsed, activate the actuator to cause the liquid discharge head to discharge the liquid being heated by the heater to a portion other than the medium as a dummy discharge operation; and cause the heater to stop heating the liquid in the liquid discharge head after the dummy discharge operation.

2. The liquid discharge apparatus according to claim 1, wherein the portion is a dummy discharge receptacle to receive the liquid discharged by the dummy discharge operation.

3. The liquid discharge apparatus according to claim 1, wherein the circuitry is further configured to:

perform a first dummy discharge operation after the discharge operation and before the predetermined period of time has elapsed.

4. The liquid discharge apparatus according to claim 3, wherein an amount of the liquid discharged by the first dummy discharge operation is smaller than an amount of the liquid discharged by the dummy discharge operation.

5. The liquid discharge apparatus of claim 1, wherein the circuitry is further configured to, in response to an image forming operation ending and the predetermined time having elapsed, perform a capping operation to cap the liquid discharge head, and turn off the heater.

6. The liquid discharge apparatus of claim 1, wherein the circuitry is further configured to, when the heater is turned off and no print instruction is received for a second predetermined period of time while the heater is turned off, turn on the heater.

7. The liquid discharge apparatus of claim 6, wherein the circuitry is further configured to, after the heater is turned from off to on, perform the dummy discharge operation in response to determining that the temperature of the liquid discharge head is above a predetermined temperature.

8. The liquid discharge apparatus of claim 1, wherein the dummy discharge operation does not use suction to force liquid out of the liquid discharge head.

9. A method of discharging liquid in a liquid discharge apparatus, the method comprising:

heating the liquid in a liquid discharge head;

discharging the liquid being heated by the heater to a medium as a discharge operation;

waiting a predetermined time after the discharge of the liquid to the medium, while continuously heating the liquid in the liquid discharge head;

in response to the predetermined time having elapsed, activating the actuator to discharge the liquid being heated by the heater to a portion other than the medium as a dummy discharge operation after the discharge operation; and stopping heating the liquid in the liquid discharge head after the dummy discharge operation.

10. The liquid discharge apparatus of claim 1, wherein the predetermined time is approximately 10 minutes.

11. The liquid discharge apparatus of claim 1, wherein the circuitry is further configured to wait the predetermined time after the discharge of the liquid to the medium in a standby state.

* * * * *